US005498171A

United States Patent [19]

Semaan

[11] Patent Number: 5,498,171

[45] Date of Patent: Mar. 12, 1996

[54] CONNECTOR LOCKING AND UNLOCKING CONFIGURATION

[75] Inventor: Joseph E. Semaan, Novi, Mich.

[73] Assignee: Ford Motor Company, Dearborn, Mich.

[21] Appl. No.: 270,557

[22] Filed: Jul. 5, 1994

[51] Int. Cl.[6] ..... H01R 13/627

[52] U.S. Cl. ..... 439/352; 439/357

[58] Field of Search ..... 439/350, 351, 439/352, 353, 354, 355, 357, 358

[56] References Cited

U.S. PATENT DOCUMENTS

| | | | |
|---|---|---|---|
| 4,634,204 | 1/1987 | Detter et al. | 439/352 |
| 4,708,413 | 11/1987 | Schroeder | 439/358 |
| 4,746,306 | 5/1988 | Yurtin et al. | 439/357 |
| 4,906,204 | 3/1990 | Metzger | 439/352 |
| 4,946,395 | 8/1990 | Cope et al. | 439/352 |
| 4,946,404 | 8/1990 | Takenouchi et al. | 439/352 |
| 4,950,175 | 8/1990 | Plyler et al. | 439/274 |
| 4,963,103 | 10/1990 | Fink et al. | 439/352 |
| 5,011,425 | 4/1991 | Zanten et al. | 439/358 |
| 5,026,298 | 6/1991 | Brussalis et al. | 439/358 |
| 5,199,902 | 4/1993 | Kahle et al. | 439/352 |
| 5,236,373 | 8/1993 | Kennedy | 439/347 |
| 5,246,380 | 9/1993 | Kodama | 439/358 |
| 5,257,944 | 11/1993 | Kennedy | 439/347 |
| 5,370,550 | 12/1994 | Alwine et al. | 439/352 |

*Primary Examiner*—Gary F. Paumen
*Assistant Examiner*—Hien D. Vu
*Attorney, Agent, or Firm*—Peter Abolins; R. L. May

[57] ABSTRACT

An electrical connector has a first connector body which has a deflectable locking member with an engagement catch and a second connector with an opening for receiving the locking member and engagement catch. A coupling assurance device can be positioned in the first connector body and allow coupling of the first and second connector bodies, due to the flexibility of the locking member, and yet prevent unintentional decoupling of the first and second connector bodies unless the coupling assurance device is removed.

5 Claims, 4 Drawing Sheets

CONNECTOR LOCKING AND UNLOCKING CONFIGURATION

BACKGROUND OF THE INVENTION

1. Field of the Invention

This invention relates to electrical connectors having connector bodies which are coupled and locked to each other by a deflectable lock member.

2. Prior Art

It is known to have a connector device for electric circuit terminals with mating male and female connectors, one of which has resilient extended lock-arm that will lock behind a lock bar of the other connector. When the two connectors are mated, a connector position assurance assist device is inserted transversely so that the locking arm cannot deflect so as to pass by the locking bar. When the position assurance device is inserted the connectors cannot be coupled to- or decoupled from each other. Therefore, such a transverse connector position assurance device can only be inserted after the two connectors are mated to each other. Since it cannot be inserted before coupling, there is the chance that the production process will be hindered either by accidental insertion of the connector position assurance device before coupling or by loss of the transverse connector position assurance device so that a coupled connector cannot be secured. In either case, the production process is disrupted, time is lost and there is additional expense. These are some of the problems this invention overcomes.

SUMMARY OF THE INVENTION

This invention is a connector device for electric circuit terminals includes first and second connectors, the first of which has a resilient extended lock arm that will lock in a lock bar opening. Further, a connector position assurance device is securely positioned in the first connector portion permits locking between the two portions but prevent unlocking between the two portions unless the connector position assurance device is removed.

Such a connector position assurance device is particularly advantageous because it can be firmly seated in the first connector portion avoiding the possibility of either falling off before the first and second portions are coupled or being accidently seated in the seating position of the first portion and thus being configured so as to prevent mating of the two portions in the seated position.

To achieve this, the connector lock arm means is sufficiently flexible to deflect during coupling of the first and second portions, thus permitting coupling, but is held in place in the coupled lock position unless the connector position assurance device is removed.

DETAILED DESCRIPTION OF THE INVENTION

Figure 1:
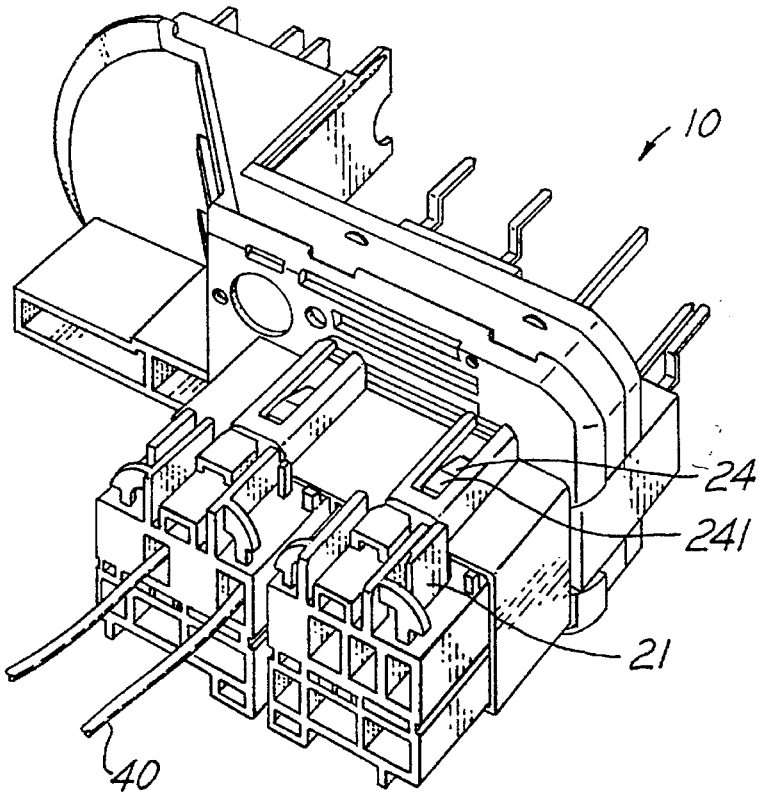
FIG. 1 is a perspective view of the entire connector in accordance with an embodiment of this invention.

FIG. 1 is a perspective view of an electrical connector 10, consisting of mateable connector bodies 20 and 30 in accordance with an embodiment of this invention. Connector 10 is shown in a mated position.

Figure 2:
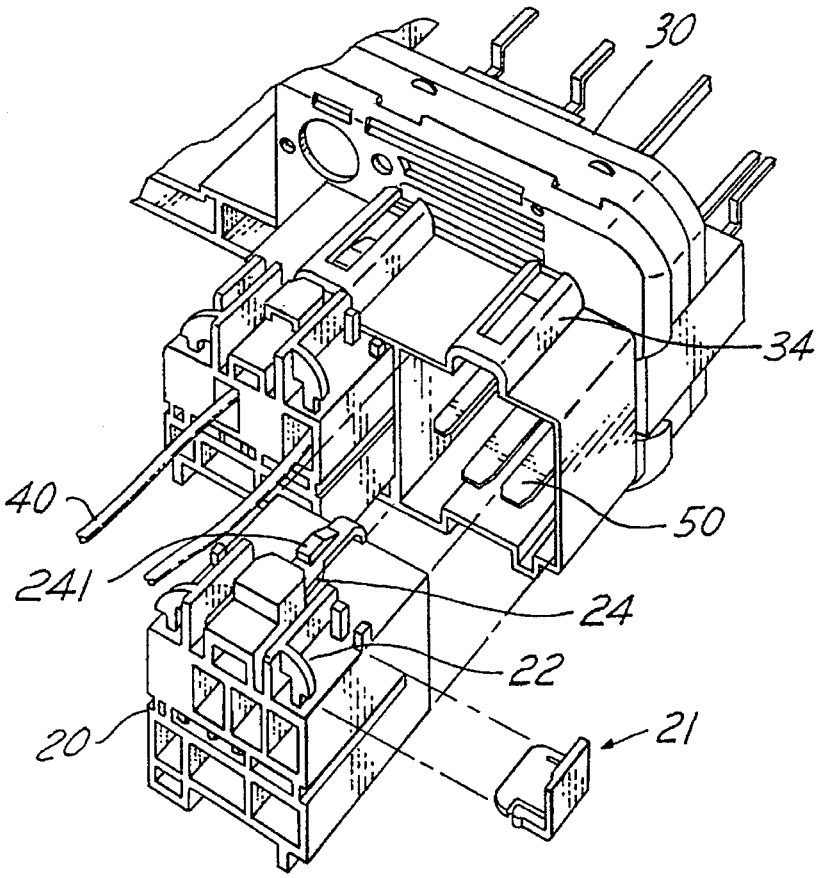
FIG. 2 is an exploded view of the connector shown in FIG. 1, in accordance with an embodiment of this invention.

FIG. 2 is an exploded perspective view of connector 10, and also a connector position assurance device 21, which acts as a locking clip that slides into a transverse opening 22 of connector body 20.

Figure 3:
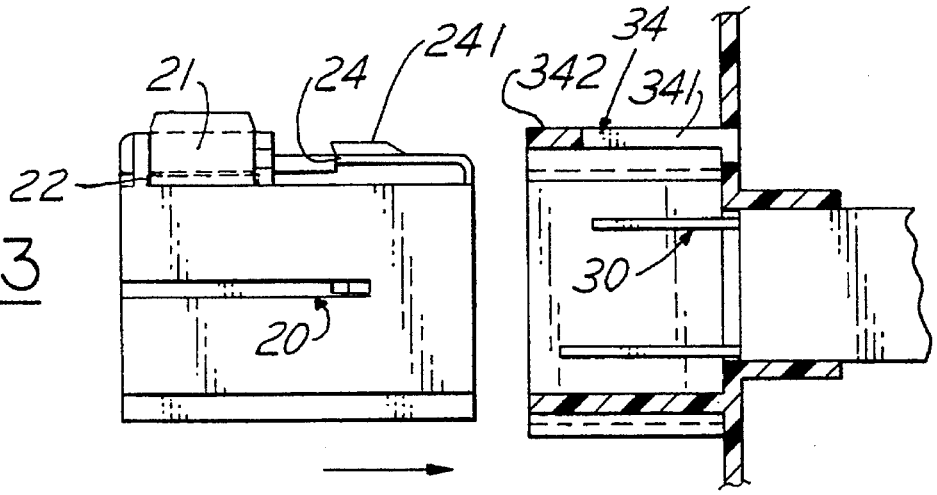
FIGS. 3, 4 and 5 are section views showing sequential steps in coupling between two bodies of a connector in accordance with an embodiment of this invention.
Figure 4:
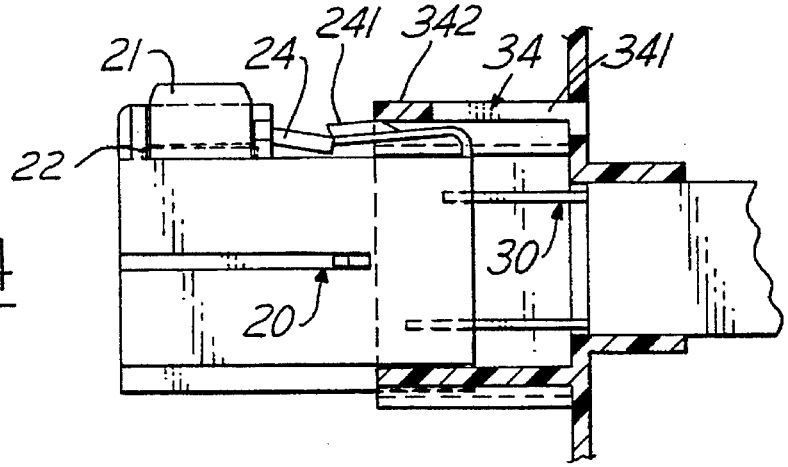
Figure 5:
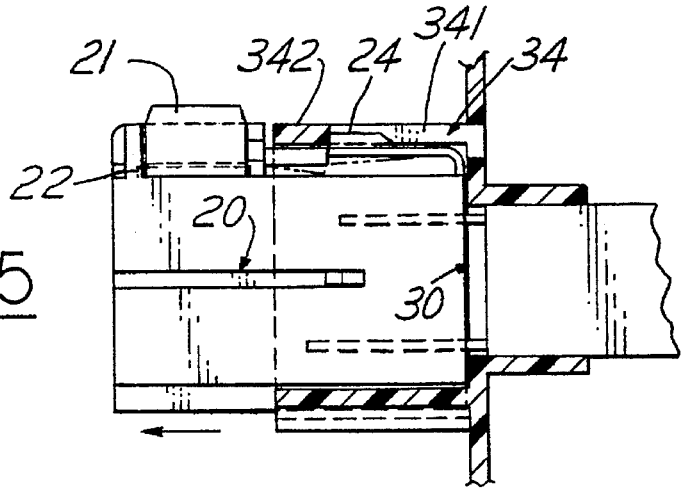

Referring to FIGS. 3, 4 and 5, a locking arm 24, of connector body 20, is an elongated, flexible lock part that bends when it slides into a corresponding wall part 34 on connector body 30. To achieve bending, a forward portion 242 on locking arm 24 is thinner than an intermediate portion 243, and intermediate portion 243 is thinner than a rearward portion 244 and sufficiently thin to permit bending of locking arm 24. That is, locking arm 24 is of her erogenous thickness with one thicker and one thinner portion. The thinner portion of locking bar 24 permits it to flex. Thus with locking arm 24, it is possible to couple connector bodies 20 and 30 even though connector position assurance device 21 is in its secured position. When coupled, connector bodies 20 and 30 are locked together by cooperating locking arm 24 and wall part 34 of the respective connector bodies 20 and 30. (FIG. 3)

Wall part 34 has an opening 341 adjacent to a locking bar 342 extending transversely across the path of locking arm 24. When in locked position, a tab 241, extending from locking arm 24 enters opening 341 and engages locking bar 342, thereby preventing connector body 20 from sliding out of connector body 30 (FIG. 5). Tab 241 is configured to have an inclined ramp on the leading edge and a substantially vertical wall on the trailing edge so that forward motion of tab 241 engages locking bar 342 and causes downward deflection of locking arm 24. A rearward force applied to locking arm 24 causes tab 241 to engage locking bar 342 and prevents rearward motion of locking arm 24.

Connector bodies 20 and 30 are separated by exerting a force on locking arm 24. By pressing locking arm tab 241 down from under its secured position, it can clear locking bar 342, and locking arm 24 can be withdrawn from wall part 34. However, to prevent this from happening accidentally, a connector position assurance device 21 is pushed under locking arm 24, thus preventing it from being able to flex in response to a rearward force or a general downward force on electrical connector 10. Although unlocking of bodies 20 and 30 can be accomplished with connector position assurance device 21 in place, there must be a relatively strong localized force applied to locking arm tab 241. Accidental unlocking is practically prevented because any force applied to locking arm tab 241 must clear wall part 34.

Figure 6:
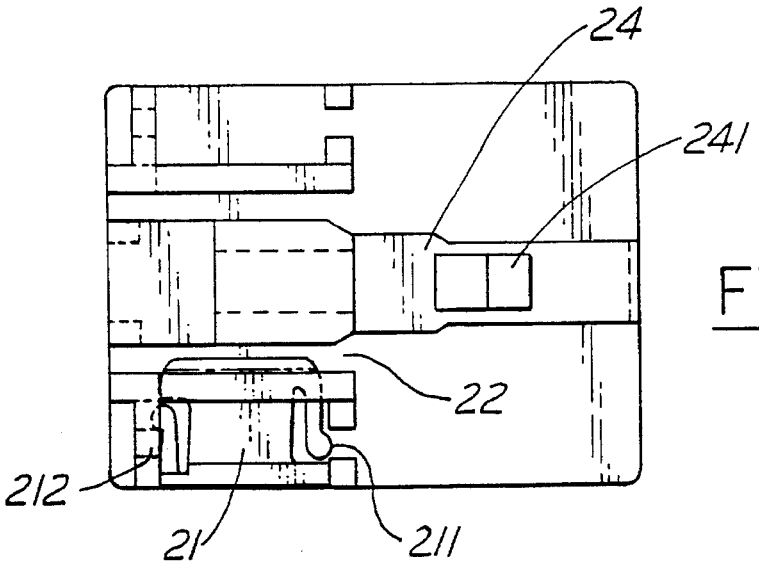
FIG. 6 is a top view of a connector component including a connector position assurance device, in accordance with an embodiment of this invention.
Figure 7:
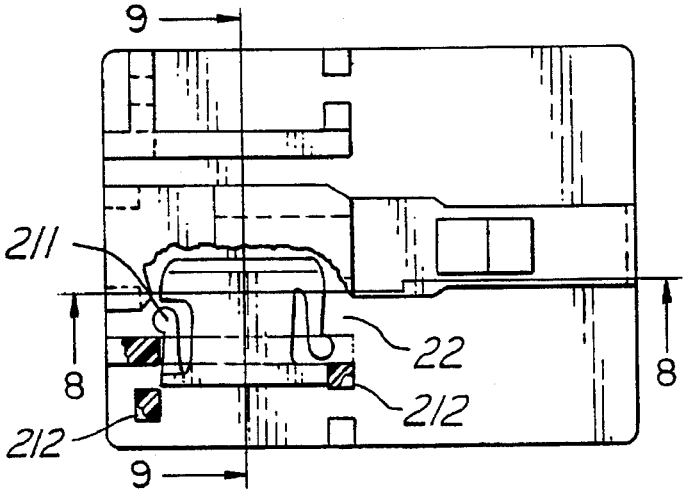
FIG. 7 is a top view of a connector component, with the top partly broken away, revealing the connector position assurance device in its locked position, in accordance with an embodiment of this invention.

FIG. 6 is a drawing of connector body 20 showing connector position assurance device 21 in the open, or unlocked position, i.e., not pushed in under locking arm 24 to lock it. FIG. 7 shows connector position assurance device 21 slid under locking arm 24. In this configuration, connector bodies 20 and 30 cannot be pulled apart.

Connector position assurance device 21 is generally L-shaped with a leg 213 for entering transverse opening 22 of connector body 20. At the sides of leg 213 are two flexible locking arms 211, that snap in place behind corresponding locking tabs 212 on connector body 20, and allow connection position assurance device 21 to be kept in a locked position.

Figure 8:
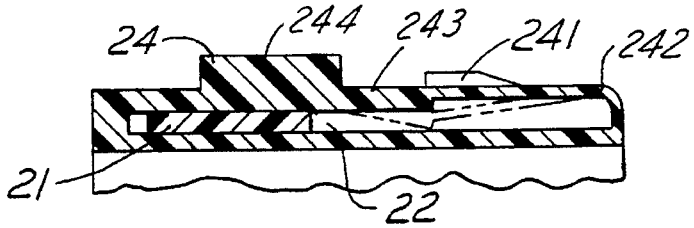
FIG. 8 is a section view along section line 8—8 of FIG. 7, showing a locking arm with connector position assurance device 21 under it, in accordance with an embodiment of this invention.
Figure 9:
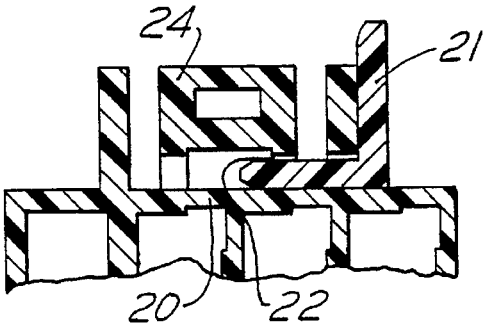
FIG. 9 is a section view along section lines 9—9 of FIG. 7 showing connector body 20 with locking clip 21, in accordance with an embodiment of this invention.
Figure 10:
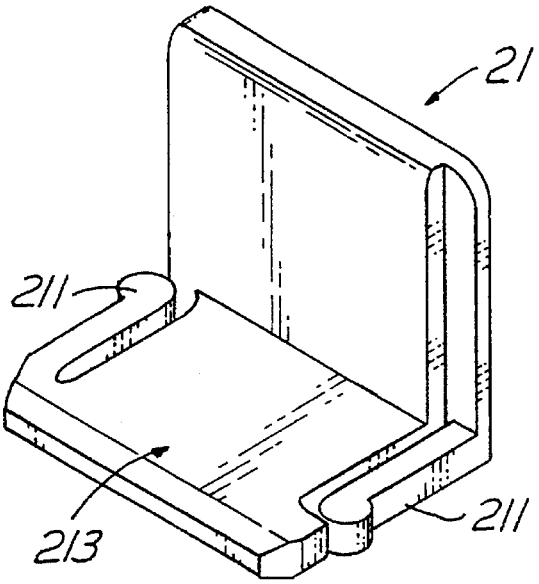
FIG. 10 is a perspective view of a connector position assurance device, in accordance with an embodiment of this invention.

Referring to FIG. 8, connection position assurance device 21 prevents locking arm 24 from deflecting (dotted lines). FIG. 9 is a section view of how connection position assurance device 21 slides in under locking arm 24 in connector part 20. FIG. 10 is an enlargement of the L-shaped connector position assurance device with its two locking arms 211.

Figure 11:
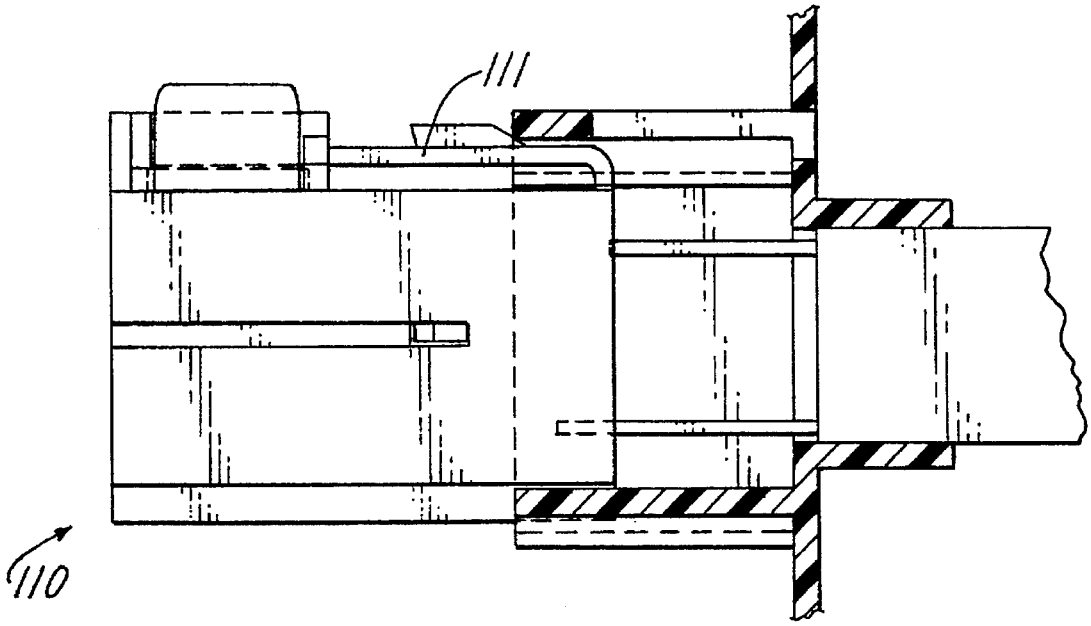
FIG. 11 (PRIOR ART)
FIG. 11 is a section view of a connector in accordance with the prior art.

FIG. 11 is a prior art drawing of an entire connector 110 with a locking arm 111, having a uniform thickness. The thickness of locking arm 111 is sufficient to prevent it from flexing when coupling if connector position assurance device 21 is put in place.

Various modifications and variations will no doubt occur to those skilled in the arts to which this invention pertains. Such modifications and variations which generally rely on the reachings through which this disclosure has advanced the art are properly considered to be within the scope of this invention.

I claim:

1. An electrical connector having first and second connector bodies which are coupled and locked together by a deflectable lock member of said first connector body which engages a lock opening of the second connector body, wherein said electrical connector further includes:

said deflectable lock member having an elongated arm attached to said first connector body at a front mating end thereof and a rigid catch extending from said arm, and a coupling assurance device coupled to said first connector body so as to reduce movement of said elongated arm so that said lock member can deflect sufficiently to couple said first and second connector bodies and deflection is substantially reduced in response to an uncoupling force thereby preventing unintentional decoupling and providing for coupling of the first and second connector bodies when the coupling assurance device is in a seated position and providing for uncoupling when the coupling assurance device is removed, wherein said elongated arm has a forward length of reduced thickness, including said rigid catch positioned thereon, an intermediate length of intermediate thickness greater than the thickness of said forward length and a rearward length of greater thickness than the thickness of said intermediate length to facilitate bending of said lock member.

2. An electrical connector as recited in claim 1 wherein at least a portion of said forward length of reduced thickness is longitudinally spaced from said coupling assurance device.

3. An electrical connector as recited in claim 1 wherein said coupling assurance device includes cantilevered arms with outwardly protruding tabs which engage sides of an opening in said first connector body.

4. An electrical connector as recited in claim 3 wherein said lock opening includes a longitudinal opening for receiving said arm and a transverse opening for receiving said coupling assurance device.

5. An electrical connector as recited in claim 4 wherein said coupling assurance device includes a generally L-shaped member having two legs, wherein one leg is positioned next to said arm to prevent uncoupling of said first and second connector bodies and is spaced from said arm during uncoupling of said first and second bodies.

* * * * *